US007188456B2

(12) United States Patent
Knauseder

(10) Patent No.: US 7,188,456 B2
(45) Date of Patent: Mar. 13, 2007

(54) CLADDING PANEL

(75) Inventor: Franz Knauseder, Salzburg (AT)

(73) Assignee: Kaindl Flooring GmbH, Wals (AT)

( * ) Notice: Subject to any disclaimer, the term of this patent is extended or adjusted under 35 U.S.C. 154(b) by 0 days.

(21) Appl. No.: 10/231,480

(22) Filed: Aug. 30, 2002

(65) Prior Publication Data

US 2004/0031227 A1 Feb. 19, 2004

(30) Foreign Application Priority Data

Aug. 19, 2002 (AT) ..... A 1244/2002

(51) Int. Cl.
*B25G 3/34* (2006.01)
*E04B 2/08* (2006.01)

(52) U.S. Cl. ..... 52/592.1; 52/589.1; 403/268

(58) Field of Classification Search ..... 52/586.1, 52/591.1, 589.1, 592.1, 591.5, 582.1; 403/268, 403/266, 265, 267, 271, 272
See application file for complete search history.

(56) References Cited

U.S. PATENT DOCUMENTS 1,846,658 A * 2/1932 Rockwell ..... 403/265
2,053,382 A * 9/1936 Leopold ..... 403/268
2,736,930 A * 3/1956 Longley ..... 52/211
3,998,024 A * 12/1976 Frandsen ..... 52/592.1
4,037,377 A * 7/1977 Howell et al. ..... 52/309.9
5,448,865 A * 9/1995 Palmersten ..... 52/309.9
5,502,939 A * 4/1996 Zadok et al. ..... 52/309.9
5,618,602 A * 4/1997 Nelson ..... 428/60
5,899,038 A * 5/1999 Stroppiana ..... 52/403.1
6,185,894 B1 * 2/2001 Sisco et al. ..... 52/457
6,314,701 B1 * 11/2001 Meyerson ..... 52/588.1
6,505,452 B1 * 1/2003 Hannig et al. ..... 52/582.1
6,581,351 B2 * 6/2003 DeVivi ..... 52/592.1
6,601,359 B2 * 8/2003 Olofsson ..... 52/588.1
2003/0037504 A1 * 2/2003 Schwitte et al. ..... 52/586.1
2003/0041545 A1 * 3/2003 Stanchfield ..... 52/592.1
2003/0145550 A1 * 8/2003 Bennett et al. ..... 52/592.1
2004/0031226 A1 * 2/2004 Miller et al. ..... 52/588.1
2004/0211143 A1 * 10/2004 Hanning ..... 52/578

FOREIGN PATENT DOCUMENTS

AT 268 000 B 2/1971
EP 0 843 763 B1 4/2000
EP 0 813 641 B1 4/2001

* cited by examiner

*Primary Examiner*—Richard E. Chilcot, Jr.
*Assistant Examiner*—Candace L. Bradford
(74) *Attorney, Agent, or Firm*—Millen, White, Zelano & Branigan, P.C.

(57) ABSTRACT

A tongue and groove cladding panel is described.

66 Claims, 6 Drawing Sheets

CLADDING PANEL

FIELD OF THE INVENTION

The invention relates to a cladding panel for floors, walls or ceilings or similar applications.

BACKGROUND OF THE INVENTION

On their side surfaces cladding panels have tongues and grooves in order to be able to install these panels in a formation. In order to achieve a formation as stable as possible it can also be provided that the panels be cemented to one another.

The priority objective of the invention is to be able to manufacture panels of the initially mentioned type as easily and economically as possible, furthermore to enable their storage over longer time intervals without adverse effects, and finally to make installation as fast and simple as possible. Another objective is to prepare a stable, durable and solid surface from the interconnected panels; during installation alignment of the panels will be possible over a certain time interval.

SUMMARY OF THE INVENTION

As claimed in the invention, in the groove or on at least one inner surface of the legs of the groove and/or on at least one surface of the tongue at least one bead or line is applied; a recess is formed to accommodate it on the surface of the tongue and/or groove which can be laid down and which is assigned at the time. The bead acts in this way in the course of installation of the cladding panels or in the course of their joining; the bead and the recess interact as locking elements. When the locking element or the bead is formed with a cement, an adhesive connection between the tongue and the groove can be achieved. The bead of plastic and/or cement is easily and quickly applied at the factory, for example sprayed on; in particular the bead is applied in the groove, with which the bead is protected against damage and dirt.

A material machining process, for example milling, to form the locking element, is eliminated.

It is only necessary to form the recess assigned to the bead in the wall surface of the groove and/or in the tongue surfaces; the formation of the locking element which interacts with this recess in the form of a bead is extremely simple. This type of joining and optionally cementing technique can be used for cladding panels of any materials, wood, derived timber products, especially MDF, HDF, chips, etc.

A series of plastics is known which can be applied as a corresponding bead or line to the surfaces of the groove and/or the tongue. In particular silicone plastics, plastics based on polyalkylene, especially PVC, PE, PP, and hot-melt cements based on neoprene can be used. These plastics should be deformable by heat or adhesive by heat and it should be possible to extrude or shape them in bead form and they should be able to solidify adhering to the respective material of the panel. In use they should have the corresponding elasticity and viscosity in order to be able to act as a catch element.

Plastics deformable by heat are especially thermoplastics, elastomers or thermoplastic elastomers. Thermoplastics can be polyolefins, vinyl polymers, polyamides, polyester, polyurethane and ionomers. Elastomers can be diverse types of rubber. Thermoplastic elastomers are especially TPE, TPR, TPO, SPS, TP-Q, TP-U. Plastics can also be hot-melt cements or hot sealing cements based on ethylene vinyl chloride, PA, PU, EVA. Other plastics can also be used.

A series of adhesive cements is known which have sufficient strength in order not to be removed when the tongue is pushed into the groove or to be damaged in their surface configuration, but as a result of penetrating atmospheric humidity and/or by application of water in the course of installation they are activated enough to fully develop their adhesive action. After hardening of the cement of the cement bead it acts on the one hand based on the adhesive action and on the other based on the developed locking action. The adhesives used will be applicable with a nozzle to the respective material of the panel and will adhere well there.

These cladding panels have the advantage that the movements and manipulation steps in installing the panels on site are considerable reduced; it is simply necessary to introduce water into the groove with the corresponding expedient and/or to apply it to the tongue in order to activate the cement, if this is desired at all. If it is a cement which sets as a result of the existing moisture in air, this procedure is not necessary.

One special advantage lies in that due to the mass of the cement placed in the cement bead at the factory, a correctly dimensioned or sufficient amount of cement is present and handling or removal of the cement which has been applied in excess at most or emergence of the cement from the tongue-in-groove joint is eliminated.

Cements are especially glues which consist of a water-soluble, animal (glutine, casein), vegetable (starch, dextrin, cellulose) or synthetic (for example, polyacrylic acid derivatives, polyvinyl alcohol, polyvinyl pyrrolidone) polymers and water as the solvent. They belong to the class of single-component cold-bonding adhesive cements in which the solvent (water) during the cementing process is sucked up or escapes. These glues solidify as they cool, especially jelly-like and generally dry to a transparent mass which decomposes upon contact with water into a gel with high adhesive force.

It is preferable if an adhesive which is dispersed in water or prepared with water or a glue is applied as the cement bead and dried in situ or at the factory. By applying water at the consumer directly to the dried adhesive layer or by indirect intensive contact with water which has been applied to a panel to be joined or its groove or tongue, or by penetrating moisture, after the panels are joined to one another the dried cement is activated and returned to the active, adhesive-ready state. The application of the aqueous activator can take place by spraying-on or application by sponge or the like.

In one advantageous approach first the cement beads are moistened with water or a water film which wets at least the cement bead as the adhesive activator is applied or sprayed onto the tongues and/or into grooves of the panels and then the panels are joined to one another. The availability time of the reactivated cement is chosen such that there is enough time for the panels to be joined to one another.

If the bead or line is made of plastic, this embodiment has the advantage that the groove and tongue can be easily locked to one another; if the bead or line is formed from an adhesive cement, locking can take place accompanied by cementing.

In this execution of the tongue and groove the cohesion of two cladding panels to be joined together is improved and a coating which has essentially considerable stiffness is achieved. In this case the cement of a cement bead can support the especially intimate connection between the tongue and groove.

The danger of damage or shearing off of the adhesive bead or a plastic bead when the tongue is pushed into the groove is reduced and its hold on the surface to which the bead adheres increases. In this connection it is advantageous if the cement bead adheres strongly in this recess and/or to the wall surfaces of the groove or the tongue surfaces. This strong adhesion is not to be lost even when the cement is activated by contact with water, in particular this adhesion is to be made as strong as possible.

It is advantageously provided that the tongue and groove are each formed lengthwise and in one lengthwise side and lengthwise and in one transverse side of a panel, optionally the tongue and/or groove and/or bead or line extending over the entire length of the respective side surface. Thus, over all sides of the cladding panels during installation with the cladding panels to be joined, an optimum joining capacity and optimum cohesion are achieved.

Connection of the panels to be joined together becomes simple when the joining of the plane surfaces is possible with low expenditure of force, it is simply necessary to overcome the elevations formed by the applied beads in order to insert them into the recesses. To do this it is provided that at least one leg, preferably the lower one, of the groove when the tongue is inserted can be elastically widened or elastically bent and/or the plastic and/or cement used has the corresponding elastic behavior or viscosity.

A good connection of two panels to be joined to one another results, a connection which can be easily accomplished and which does not require additional space. The shape of the adhesive bead results in that it comes into contact with the tongue surface or the wall surface of the groove of the panel to be joined and thus the two panels are cemented to one another. Completed elastic widening of the legs of the groove by the cement bead which is introduced into the recess is undone again by the cement which becomes softer in the course of activation; thus the cross section of the cement bead and the cross section of the assigned recess can overlap to a certain extent.

It is provided as claimed in the invention that the cement of the cement bead or line is water-soluble or can be partially dissolved and/or activated upon contact with water or with supply of water and/or moisture and/or is formed by water-soluble glue, for example white glue, and/or by a pressure cement or a pressure-activated cement or one which develops adhesive action when pressure is applied.

It is furthermore provided as claimed in the invention that the panel is formed from derived timber products, MDF, HDF, plastic, recycled plastic, chips with artificial resin or bonded chips (particle board) and optionally provided with at least one coat, for example a decorative coat, especially of plastic, paper impregnated with synthetic resin, wood, or the like on its front or working surface and/or on its back.

The cross sectional shape of the bead can be diverse; it is advantageous if the bead or line and/or the recess and/or the recess in cross section has a semicircular, lenticular, elliptical or elongated-rectangular shape, and/or that the transitions from the flat surfaces to the recesses and/or to the recesses run rounded or bevelled.

Good cohesion of two panels to be joined or of the tongue and groove results when the cement bead is reliably in contact with the parts to be connected, specifically the tongue and groove of two panels which are to be connected.

It is especially advantageous when the bead performs a double function, specifically it acts as a locking element and as an element for joining two panels. With one such component which is called an outside tongue it is simply necessary to mill grooves on the peripheral surfaces of a panel; the components can be quickly produced in large amounts; the components are joined to the panels in part at the plant or this remains for the user to do.

In one especially advantageous embodiment of the invention the grooves and tongues are not pointed perpendicular to the lateral surfaces of the panels, but run perpendicular to the top surface of the panels. Thus the tongue and groove can be locked when the panels are installed by movement which takes place perpendicular to the panel surface. Nevertheless all the advantages of the above described tongue-in-groove connection possibilities can be used or provided.

BRIEF DESCRIPTION OF THE DRAWINGS

The invention is detailed below using the drawings which show for example schematic embodiments of the invention.

DETAILED DESCRIPTION

Figure 10:
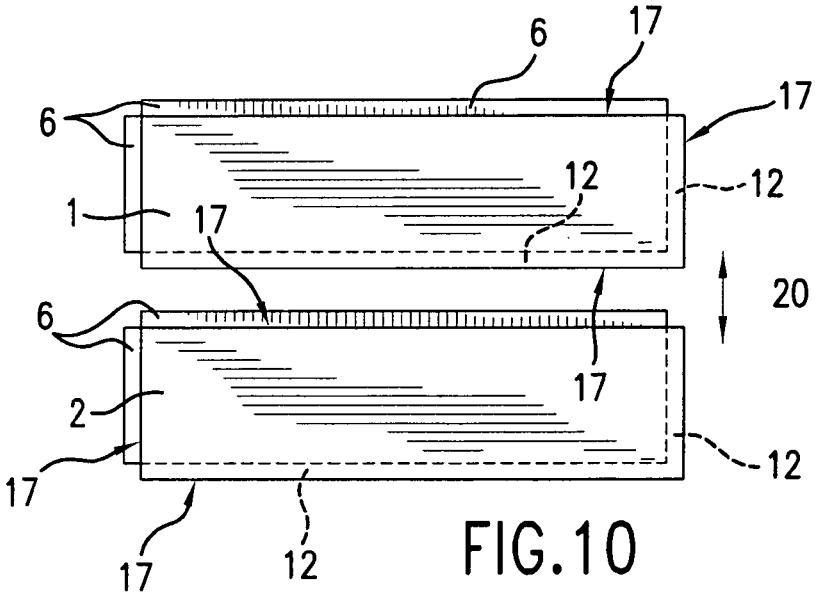
FIG. 10 schematically shows two cladding panels being joined to one another.

FIG. 10 schematically shows two cladding panels 1, 2 which are to be pushed onto one another in the direction of the arrow 20 and joined to one another. This pushing or joining can take place in the last step only in the plane spanned by the two panels 1, 2. On their lengthwise side the two panels each have a tongue 6 which projects from the face surface 17 and on the opposite lengthwise side a groove 12 which is made in the face surface 17. The same conditions prevail on the face surfaces 17 of the narrow sides, each of the panels 1, 2 has one groove 12 and one tongue 6 on the face surface 17 of these narrow sides.

The shape of the tongue and groove are matched to one another in order to ensure a good connection between the tongue and groove. This shape allows insertion of the tongue 6 into the groove 12 when the panels 1, 2 are aligned in the plane of the panels. It is possible to connect the panels 1, 2 in a checkerboard manner or offset against one another. Connection both on the lengthwise sides and also on the narrow sides takes place by displacement essentially in the plane spanned by the panels 1, 2.

Figure 1:
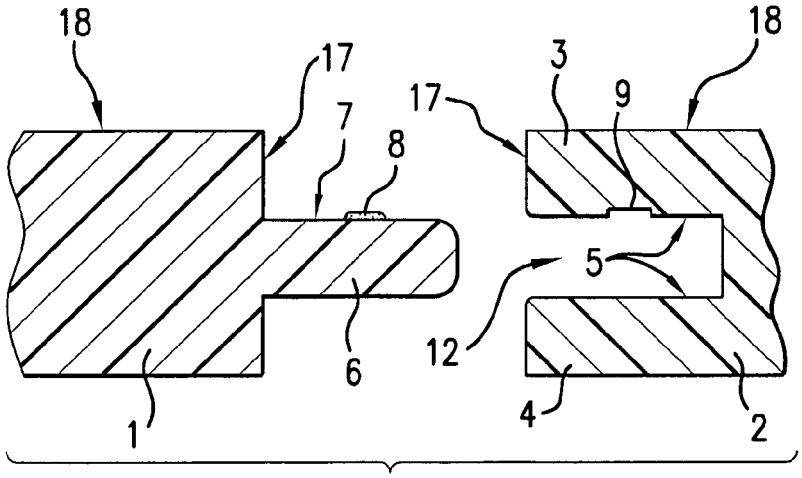
FIGS. 1 to 9 and 11 to 14 show schematic sections through cladding panels.

FIG. 1 schematically shows a section through two panels 1, 2 which are to be joined. The panel 1 has a tongue 6 which is inserted into a groove 12 of the panel 2 until the face sides 17 adjoin one another in the upper area or in the area which is near the top surface 18 of the panels 1, 2. The boundary edges of the groove 12 can be rounded or bevelled.

On at least one tongue surface, in this case the tongue surface 7 near the top surface, a bead 8 is applied or adheres especially strongly to the tongue surface 7. At one location of the wall surface 5 of the groove 12 or of the leg 3 near the surface, which location is assigned to or corresponds to the joined panels, a recess 9 is formed which is matched in its cross section to the bead 8 in the otherwise plane wall surface 5. When the two panels 1, 2 are joined or when the tongue 6 is inserted into the groove 12 the bead 8 comes to rest in the area of the recess 9 or can engage this recess 9. Advantageously it is provided that the cement of the cement bead or line 8 is water-soluble or upon contact with or upon supply of water and/or moisture can be partially dissolved and/or activated and/or is formed by water-soluble glue, for example white glue, and/or by a pressure cement or a cement which can be pressure-activated or which develops adhesive action when pressure is applied. Activation of the cement of the cement bead 8 can take place by wetting the cement bead 8 with water before the panels 1, 2 are joined or by introducing water into the groove 12 or into the recess 9. Depending on the choice of the cement it can also be provided that after engagement of the cement bead 8 with the recess 9, the atmospheric humidity when penetrates in the use of the panels 1, 2 activates the adhesive capacity of the cement bead 8 and thus an adhesive connection between the tongue 6 and the leg 3 of the groove 12 is established. Fundamentally cements could also be used which can be activated with substances other than water.

For joining panels 1, 2, in this case for inserting the tongue 6 which is provided with the bead 8 into the groove 12, it is provided as claimed in the invention that at least one leg 3, 4 of the groove 12 can be elastically widened or elastically bent up when the tongue 6 is inserted.

Fundamentally it is possible to form at least one or more beads (8) and/or recess(es) 9 which are parallel next to one another on one or both tongue surfaces 7 or on one or both wall surfaces 5 of the groove 12. It must simply be watched that a corresponding recess 9 at the corresponding location in the wall opposite it is assigned to each bead 8.

Figure 2:
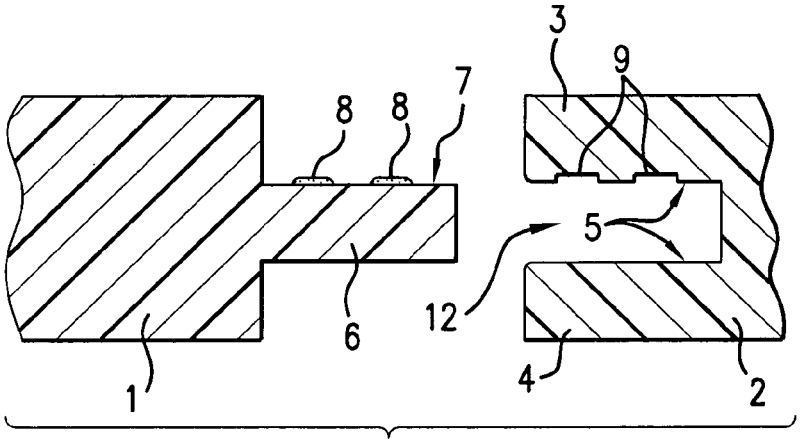

Accordingly, in FIG. 2 two beads 8 which have been applied to the tongue 6 are formed; at the corresponding location on the wall surface 5 of the groove 12 two recesses 9 correspond to these beads 8. In this way cementing and/or locking of the tongue and groove can be improved.

Figure 3:
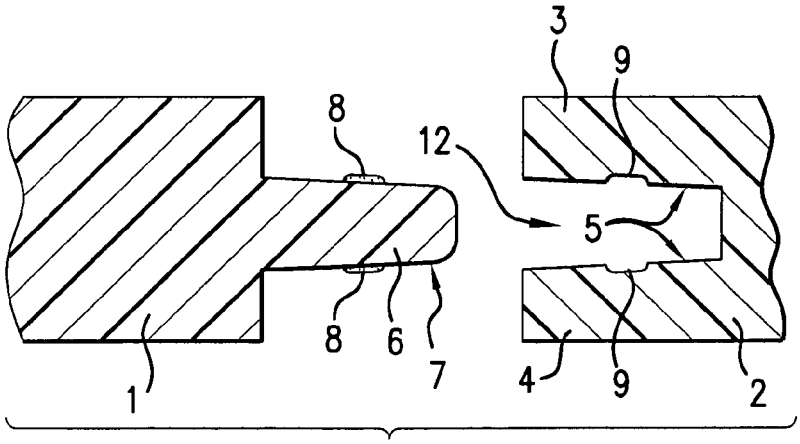

In one embodiment as shown in FIG. 3 it is provided that the two tongue surfaces 7 converge toward the free end of the tongue 6 and that the wall surfaces 5 of the groove 12 are tilted at the same angle as the tongue surfaces 7 and converge to the outside.

It can apply to these and also all other embodiments that advantageously the tongue 6 and the groove 12 can be connected by form-fit or with a snug fit at least over part, optionally over the entire insertion area of the tongue 6 and/or that the area of the tongue 6 which is located in front of the bead or line 8 or the recess 9 toward the free end of the tongue 6 can be inserted into the groove 12 by form-fit or with a snug fit. In all embodiments it can be provided that the tongue 6 and/or the groove 12 and/or the bead or the line 8 extend over the entire length of the respective side surface 17 and/or that the bead or line 8 and optionally the recess 9 and optionally the recess 10 extend continuously over the length of the groove and/or the tongue 6 or are applied or formed in the form of individual successive segments.

As the material of the panels as claimed in the invention it is advantageously provided that the panel 1, 2 is formed from wood, derived timber products, MDF, HDF, plastic, recycled plastic, chips with artificial resin or bonded chips (particle board) and optionally is provided on its front or working surface and/or on its back with at least one coat 13, 14, for example a decorative coat, especially of plastic or paper impregnated with artificial resin. Furthermore it can be advantageously provided that the groove 12 and the tongue 6 are made of the material of the panel 1,2 or are milled out from it, or that the tongue 6 is formed in one piece with the material of the panel 1,2. In all embodiments and also in the embodiment as shown in FIG. 3 it can be provided that the bead(s) or line(s) 8 can be locked to the assigned recess(es) 9 in the tongue 6 and/or in the groove 12 and the bead(s) or line(s) 8 and recess(es) 9 interact as locking elements.

Figure 4:
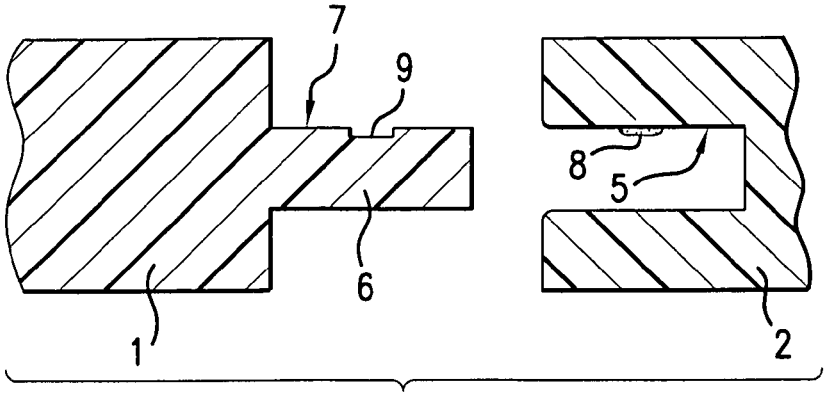

In one embodiment as shown in FIG. 4 it is provided as claimed in the invention that on one wall surface 5 of the groove 12 a bead 8 is formed; at the corresponding position on the tongue surface 7 a recess is formed for accommodating the bead 8. Thus both locking and also cementing of the two panels 1, 2 which are to be joined to one another are possible.

Figure 5:
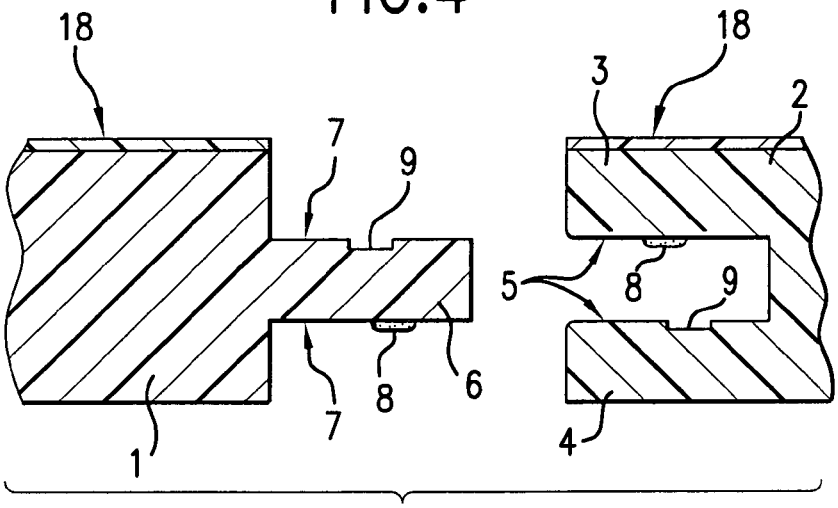

In the embodiment as shown in FIG. 5 it is provided that on the tongue surface 7 near the top surface a recess 9 is formed and that on the tongue surface 7 away from the top surface a bead 8 is applied. Accordingly, on the wall surface 5 of the leg 3 of the groove 12, i.e. the wall surface near the top surface, a bead 8 is formed and on the wall surface 5 of the leg 4 a recess 9 is formed. As can also be seen from FIG. 5, the bead 8 and the recess 9 can be assigned to one another in terms of location in order to enable corresponding locking and optionally cementing.

Figure 6:
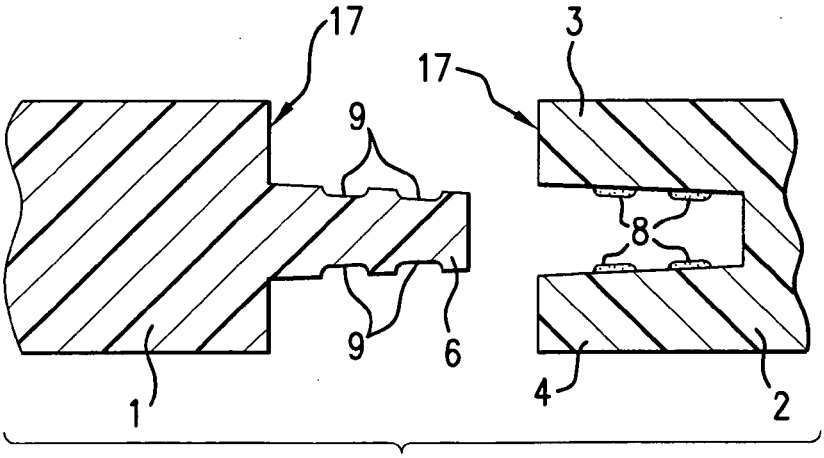
Figure 7:
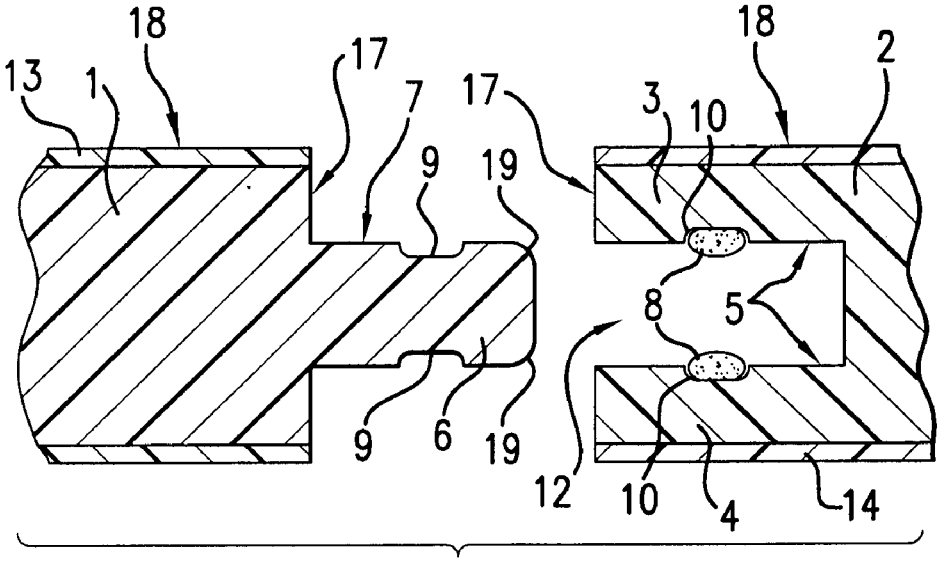

In the embodiment as shown in FIG. 6 it is provided that on each tongue surface 7 two recesses 9 at a time are formed at a distance from the face surface 17 of the panel 1; accordingly, in the wall surfaces 5 of the legs 3 and 4 two beads 8 are formed at a time at the corresponding interval or at the corresponding distance from the face surface 17 of the panel 2.

Figure 15:
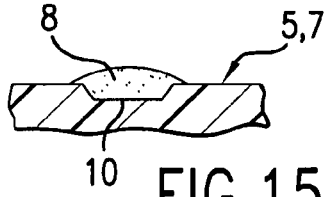
FIG. 15 shows one detail of a bead.

It can be provided as claimed in the invention that part of the bead or line 8 is located countersunk in a recess 10 which is made in the wall surface 5 of the groove 12 and/or in the tongue surface 7. The recess 10 also helps to join the applied bead 8 securely to the respective wall surface and also when the tongue 6 is inserted into the groove 12 to prevent it from being sheared off. As shown in FIG. 15, the bead 8 can also extend over the recess 10 to the surfaces 5 or 7.

The panels 1, 2 can be provided with coats 13 and 14 of for example wood, plastic, paper or the like in order to configure the working surface or the bottom surface accordingly. These coats however do not have any effect on the connecting technique as claimed in the invention.

The selected cross sections of the recesses 9 and the recesses 10 or the beads 8 can be chosen at will; the area of the bead 8 projecting out of the recess 10 or over the wall surface 5 of the groove 12 or the tongue surface 7 is accommodated by the recess 9 and comes into contact with their surfaces and optionally cements the tongue 6 to the legs 3, 4 of the groove 12. The cross sectional shape of the recesses 9 can be elongated-rectangular, triangular, lenticular, triangularly elliptical or the like.

Figure 11:
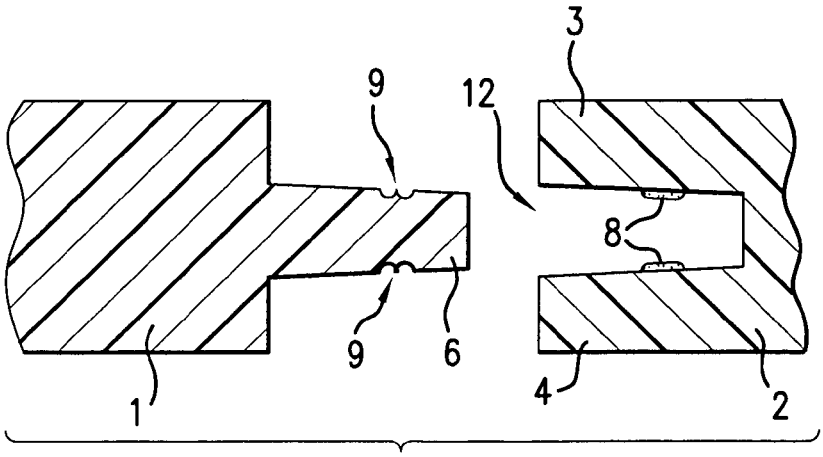

Fundamentally, as also shown in FIG. 11, the recess 9 can be formed by a row of recesses which are located directly next to one another and which together constitute the recess 9 which is in the form of a compound recess having more than one channel. In this case the corresponding shaping of the bead and/or corresponding water application for the cement bead 8 can be provided or this cement bead can be partially dissolved accordingly so that it softens enough and can assume or fill the cross sectional shape of the recesses 9. Alternatively the plastic of the bead would have to have the correspondingly high elasticity or viscosity.

It should be fundamentally avoided that the legs 3, 4 of the groove 12 which are elastically widened when the tongue 6 is inserted into the groove 12 remain in the widened position. In the widened state the joint 16 between the surfaces 18 of the two panels 1,2 would form a step which would be subject to increased wear. In one especially advantageous embodiment of the invention it is provided that the leg 3 of the groove 12 near the top surface is made more or less elastic, especially inelastic overall, and only the leg of the groove near the bottom or the lower leg is made to be elastically deflected. In this way it can be avoided that the upper leg 3 near the surface is bent up by more or less deformable beads 8, but only the lower weaker or thinner leg 4 of the groove 12 is bent. Advantageously, to prevent the upper leg 3 of the groove 12 from being bent up it can also be provided that the bead(s) 8 is (are) made only on the tongue surface 7 pointed down or on the wall surface 5 of the lower leg 4 of the groove 12. In this way both the tongue 6 and also the upper leg 3 of the groove 12 would counteract arching of the connecting site when the extent or volume of the bead is made too large or when using a cement it is not made soft enough and the volume provided for it is not enough.

The shape of the recess 10 can be lenticular, triangular, semielliptical or elongated-rectangular; it is provided that this recess 10, like the recess 9, is made as a depression in the otherwise plane tongue surface 7 or the plane wall surface 5 of the groove 12. Thus the application of cement or the amount of plastic for the bead 8 will be defined or limited to certain areas.

Figure 8:
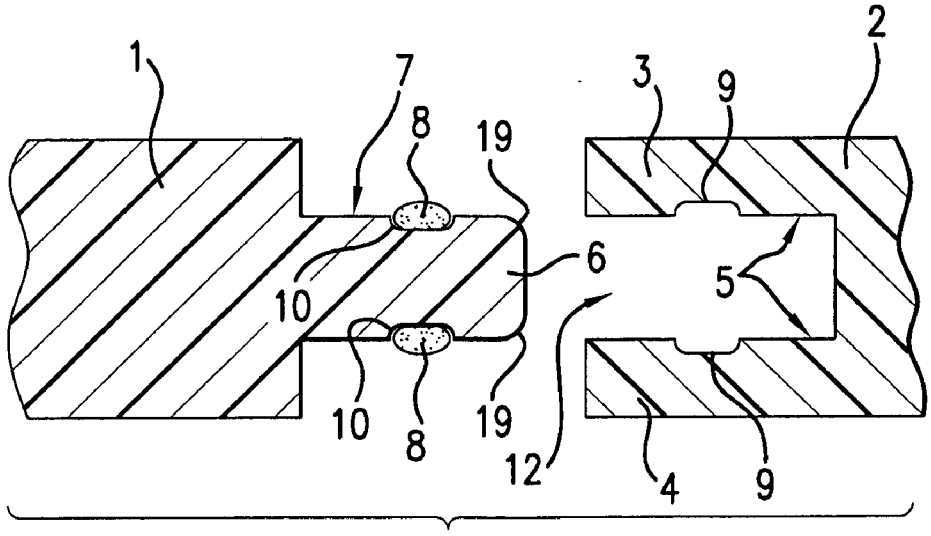

In the embodiment as claimed in the invention as shown in FIG. 8, it is provided that in the tongue surfaces 7 of the tongues 6 recesses 10 are formed which each accommodate one bead 8. The two beads 8 have different cross sections. It is quite possible to make the beads which are located in the two wall surfaces 5 of a groove 12 or on the two tongue surfaces 7 of a tongue 6 differently; accordingly then also the recesses 2 which accommodate the beads must be made differently. In the case of FIG. 8 the recess 9 made in the leg 3 is larger than the recess 9 which is made in the leg 4.

It can be advantageous if the front edge areas of the tongue 6 have curves or bevels 19, as is shown in FIG. 1, 3, and 7 and 8 in order to be able to displace the legs 3, 4 or the beads 8 as carefully as possible away from one another when the tongue 6 is inserted into the groove 12.

Figure 9:
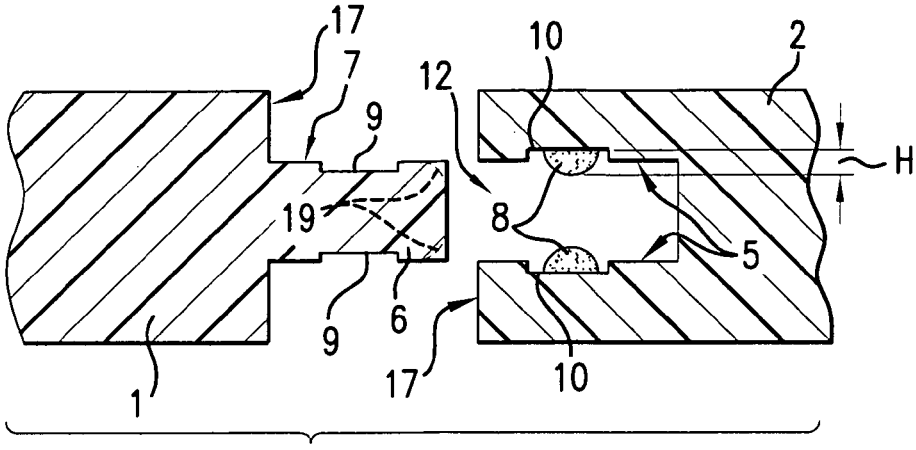

In the embodiment as shown in FIG. 9, it is provided that the cement beads 8 which are formed on the wall surfaces 5 of the groove 12 have a vertical extension H which exceeds the common depth of the recess 9 and the recess 10. In order to achieve a joint-free surface connection here or to prevent a residual widening of the groove, there is a cement which becomes soft by absorbing water or by being wetted with water such that it deforms and fills the free space 23 in the recess 10 and the free space 23 of the recess 9.

Figure 12:
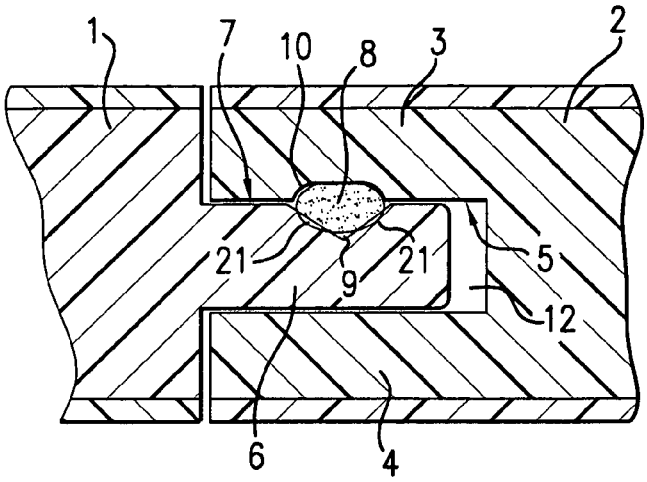

In the embodiment shown in FIG. 12, it is provided that the bead 8 which has been applied in the recess 10 in the wall surface 5 of the groove 12 overlaps with respect to its cross section with the cross section of the preferably triangular recess 9 which is located in the facing tongue surface 7 of the tongue 6. The overlapping areas 21 are softened accordingly for cement beads by activation of the cement of the cement bead 8 with water so that the cement bead 8 can adapt to the shape of the recess 9 with simultaneous cementing and locking of the two panels 1, 2 which are to be connected to one another. For plastic beads the plastic would have to have the corresponding viscosity.

Figure 14:
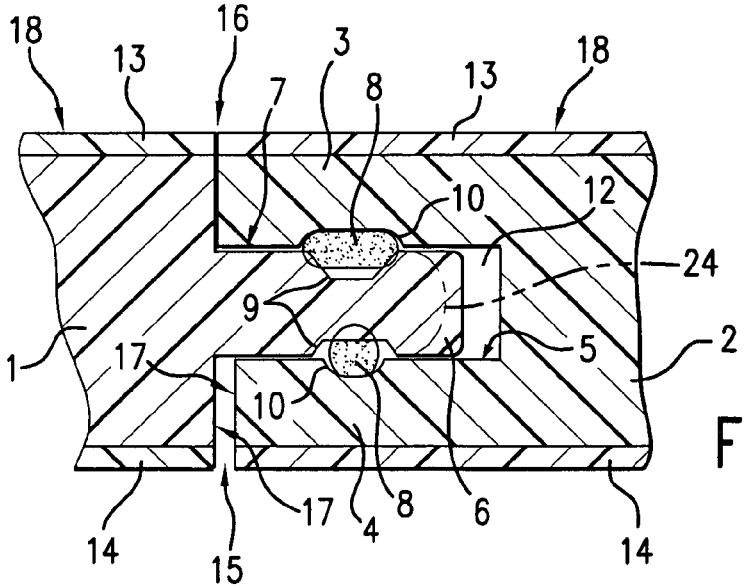

FIG. 14 shows beads which have recesses 10 which have different cross sections in comparison to one another and which are provided in recesses 10 which are made differently in comparison to one another in the two wall surfaces 5 of the groove 12, especially cement beads or lines 8 which interact with recesses 9 which are different from one another and compared to the cement beads 8 in the tongue surfaces 7 of the tongues 6.

As can be seen in FIG. 14, the tongue 6 can have fundamentally or in all embodiments a curve 24 directly in front of the recesses 9. Thus it also becomes possible to make the tongue 6 shorter and the groove 12 less deep. Furthermore, it is shown in FIG. 14 that the joint 16 in the area of the panels 1, 2 near the surface is made such that the areas of the face surface 17 which are near the top surface adjoin one another and a gap is avoided as much as possible. In the area of the panels 1, 2 near the bottom or away from the top surface it is provided that the face surfaces 17 do not touch one another and that a gap 15 is formed in between. This is achieved especially in that the leg 4 of the groove 12 near the bottom is made slightly shorter than the leg 3 near the top surface.

It is generally advantageous if the bead or the line 8 is applied in the middle to the tongue surface 7 or to the wall 5 of the groove 12 or of the legs 3, 5.

Figure 13:
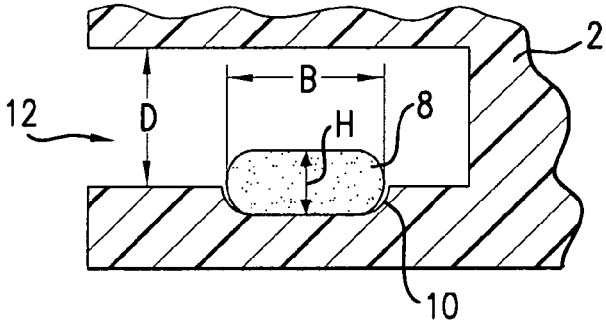

The different dimensions of the bead, especially a cement bead 8, and the groove 12 are plotted in FIG. 13. Information relating to advantageous embodiments of beads, especially cement beads, is given by this figure.

It can be provided as claimed in the invention that the width B of the bead or line 8 is twice to nine times, preferably twice to seven times, especially three to seven times, as great as its height. Furthermore, as claimed in the invention it can be provided that the cement bead or line 8 comprises an adhesive-latent cement material, preferably a polymer cement which can be emulsified with water, and the cement material can be converted by wetting with water into the adhesive-ready or adhesive state and/or that the plastic or the cement material of the cement bead or line 8 which can be (re)activated with water or moisture is applied with an essentially uniform layer thickness from 0.1 to 0.6 mm, especially from 0.2 to 0.5 mm, at thickness tolerances in the range of ±0.05 to 0.1 mm and/or that the cement of the cement bead or line 8 is formed by a quick-setting or mounting glue based on polyvinyl acetate, such as for example Dorus MDO 55 from Henkel, or by a commercial wood glue, for example based on starch or protein. It can be advantageous if the width B of the cement bead or line 8 corresponds to 5 to 25%, preferably 9 to 21%, especially 12 to 17% of the thickness D of the groove 12.

It should be noted that the beads 8 can be attached to the corresponding surfaces 5, 7 either directly on these surfaces 5, 7 or in the recesses 10 which were formed in the especially plane surfaces 5, 7. Advantageously the applied beads 8 project roughly 0.2 mm over the respective surface 5, 7. The recesses 9 which have been formed for holding the cement beads 8 have a depth of advantageously a maximum 0.3 mm. It is especially advantageous if roughly triangular recesses 9 interact with the beads 8 which are lenticular in cross section. In this respect reference is made to the embodiment of FIG. 12.

Advantageously the tongue 8 on each tongue surface 7 has a recess 9 and a cement bead 8 is applied to each leg 3, 4 of the groove optionally 12 in a recess 10.

The significant effect of the applied bead is its locking action which is used especially in the course of installation and matching of the panels to be joined.

With the corresponding rounding of the edges of the free end of the tongue 6 and/or rounding of the inside edges of the wall surfaces 5 of the legs 3, 4 of the groove 12 it is possible during installation to place the panels 1, 2 to be joined to one another first at a certain angle on one another in order to achieve entry of the tongue 6 into the groove 12 to a certain extent. The final locking of the tongue 6 and groove 12 or the last locking step which ends with contact of the face surfaces 17 in the area near the top surface is possible only when the panels 1, 2 are pushed relative to one another in the plane of the panels.

Fundamentally, it is also possible to apply cement in excess and to make the cross section of the cement bead 8 larger than the cross section of the recess 9. In this case the cement which has been softened by the solvent, especially water, would enter the gap between the groove and the tongue. This could be advantageous for the strength of the tongue-in-groove connection. But care should be taken that the cement is softened or becomes soft accordingly, so that in the joint area of the panels 1, 2 to be joined to one another no unevenness is formed. The amount of cement to be applied in the cement bead 8 thus depends on the geometrical circumstances between the tongue 6 and the groove 12 and on the size of the recesses 9 and 10 and especially also on the viscosity of the reactivated cement.

Figure 16:
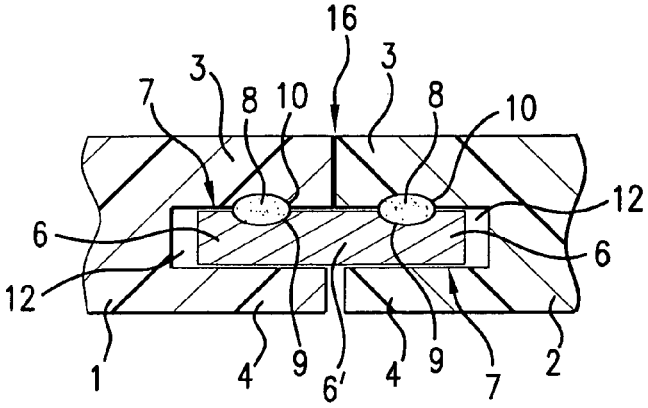
FIG. 16 shows one embodiment of the invention in which the tongue is made in the form of an "outside tongue" and is inserted into the grooves of adjacent panels or panels to be connected.

FIG. 16 shows one embodiment of the invention in which the tongue construction is made such that the side surfaces 17 on which the panel 1, 2 should have a tongue which is designed to interact with the groove of the panel to be connected are made such that first a groove 12 is formed there into which a tongue 6' of an independent component can be inserted. This tongue 6' as an independent component takes the place of the tongue 6 described in the figures and the specification and claims and is joined or can be joined to the panel 1, 2 optionally at the factory. The tongue 6' is made along its two sides like the tongue 6 and is made on both sides as is described in conjunction with the specification, drawings and claims for a tongue 6. It can be provided that the tongue is made mirror-inverted. With one side the tongue 6' is inserted into the groove of the panel 1 and with the other side into the groove of the panel 2. In doing so the beads 8 and/or the recesses 9 on the tongue surface 7 lock with the recesses 9 and/or beads 8 in the legs 3, 4 of the respective grooves 12.

The component constitutes a doubled tongue 6. The advantage of the so-called outside tongue is that the panels 1, 2 can be made all-around with the corresponding grooves 12 on their side surfaces and the outside tongues can be inserted into the grooves 12 at the factory or only when being installed. The insertion of an outside tongue 6' also takes place in the plane of the respective panel 1, 2. The panels 1, 2 are also joined when using outside tongues 6' at least in the last joining step by displacement in the plane of the panel.

All details for the tongues 6 apply both to the left part and also the right part of the component 6' shown in FIG. 16.

Figure 17:
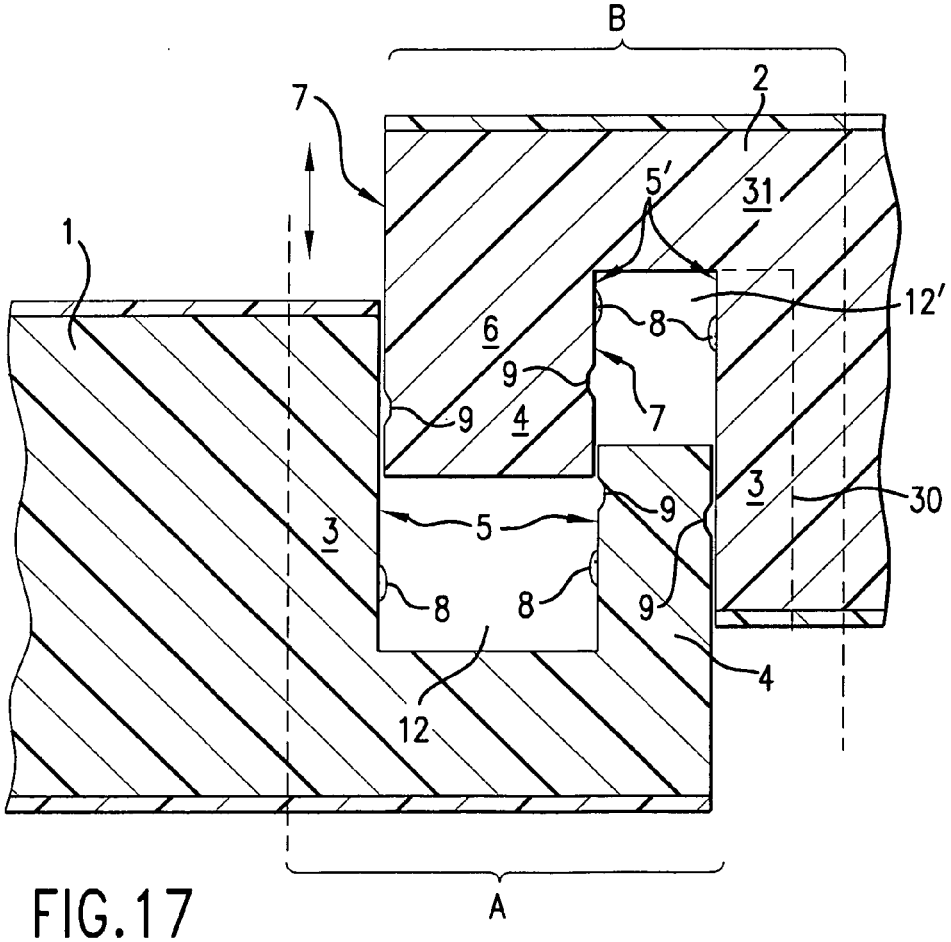
FIG. 17 shows one especially advantageous embodiment of the invention.

FIG. 17 shows one embodiment of the invention in which the grooves 12 are made perpendicular to the side surfaces 17, but run turned perpendicular to the top surface of the panels 1, 2 i.e. turned by 90°. The groove area A is formed or made in the same way as grooves 12 which are described in FIGS. 1 to 16 or the pertinent description and the pertinent claims. A tongue 6 which likewise corresponds to the tongues 6 interacts with this groove 12, and they have been described in previous FIGS. 1 to 16 and in the preceding description and the claims. The tongue 6 can likewise be viewed turned by 90°. The area A is thus simply the hitherto described connecting area of the groove 12 to the tongue 6, only that in this case the groove 12 and the tongue 6 run perpendicular to the top surface of the panels 1,2. Therefore connection of the panels 1, 2 takes place, not by displacement in the plane of the panel, but by displacement perpendicular to the surface of the panels 1, 2. The panels cannot easily swivel in; in the final step of joining movement takes place perpendicular to the plane of the panel.

As already described above in conjunction with FIGS. 1 to 16, on the wall surfaces 5 of the groove 12 and/or on the tongue surfaces 7 recesses 9 and/or beads 8, especially cement beads, are formed in order to accomplish mutual locking of the groove 12 to the tongue 6 and at best mutual cementing.

Furthermore, the area B which is made in the panel 2 can be defined as a groove area turned by 90° in the sense of the preceding description and FIGS. 1 to 16 and the claims. The leg 4 of this groove area B interacts on the one hand as the tongue 6 with the groove 12 of area A; however on the other hand the leg 4 with the body 31 of the panel 2 also forms a groove 12' into which the leg 4 of the area A can be inserted. One or both sides of the leg 4 can be provided with beads 8 and/or recesses 9 which interact with beads 8 and/or recesses 9 made in or on the wall surfaces 5' of the groove 12'. The execution of these beads 8 and the recesses 9 in the groove 12 and/or on the tongue 6 was already detailed in the preceding description.

To the extent it is provided that the panel 2 in its lateral end area ends with a boundary surface 30 at a distance from the outside leg 4 of the groove 12 in order to facilitate joining of the panels 1, 2, the corresponding beads 8 and/or recesses 9 are provided only on the tongue 6 which can be inserted into the groove 12 of the area A of the panel 1.

The leg 3 of the tongue 12 in the panel 1 is integrated into the body of the panel 1 or is constituted by the panel body.

The beads 8 can in turn be located in depressions 10; in FIG. 17 these depressions 10 however are not drawn. The above described cements and/or plastics are used for the beads 8.

The grooves 12, tongues 6, recesses 9 and 10 are preferably producing by milling.

The beads or lines 8 of cement and/or plastic are formed of linear deposits of applied material which are of hardness and viscosity sufficient to withstand insertion of the tongue portion into the groove portion so that the beads or lines initially positively latch the tongue and groove portions 1 and 2 together interacting as locking elements.

The invention claimed is:

1. A cladding panel for coupling with an adjacent complementary panel, the cladding panel comprising:

a tongue portion extending from a first edge of the cladding panel for receipt in a groove in a complementary cladding panel;

a groove portion having walls extending in a second edge of the cladding panel for receiving a tongue portion of a complementary cladding panel;

at least one linear deposit of applied material deposited on one of the portions to fix the linear deposit on said one portion as a solid prior to coupling that portion to a complementary portion on a complementary panel, the applied material having to a hardness and a viscosity sufficient to withstand insertion of the tongue portion into the grove portion in a direction transverse thereto without loosing an ability to seat in a recess and without being displaced with respect to said one portion, and at least one recess on the other portion for receiving the linear deposit of applied material on said one portion of a complementary panel therein after deflection of at least one wall of the groove portion to initially positively latch the tongue and groove portions together when the cladding panel is coupled with a complementary cladding panel.

2. The panel of claim 1 wherein the linear deposit is a deposit of adhesive which adheres to the recess.

3. The panel of claim 2 wherein the adhesive is activated by the presence of moisture or by application of pressure.

4. The panel of claim 2 wherein the deposit of adhesive is on the tongue portion and wherein the recess is a wall of the groove portion.

5. The panel of claim 4 wherein there is more than one deposit of adhesive on the tongue portion and more than one recess in the wall of the groove portion.

6. The panel of claim 5 wherein the tongue portion has two converging surfaces that converge toward a free end.

7. The panel of claim 6 wherein the deposits of adhesive are on both converging surfaces and wherein the recesses are in opposed converging walls of the groove portion.

8. The panel of claim 2 wherein the recess is in the tongue portion and the deposit of adhesive is on one of the walls of the groove portion.

9. The panel of claim 2 wherein there is more than one recess in the tongue portion and more than one deposit of adhesive on the walls of the groove portion.

10. The panel of claim 9 wherein the tongue portion has surfaces which converge toward a free end and the groove portion has walls which converge toward a bottom and have the deposits of adhesive thereon.

11. The panel of claim 2 wherein the tongue portion has two surfaces with a recess in one surface and a deposit of adhesive on the other surface, and wherein the groove portion has two opposed walls with a recess in one wall for receiving a deposit on the tongue portion and a deposit on the other wall for receipt in a recess in the tongue portion.

12. The panel of claim 2 wherein the tongue portion has two surfaces each of which has a recess and wherein the groove portion has two walls each of which has a deposit of adhesive, the deposits of adhesive being disposed in recesses in the walls for receipt in the recesses in the surfaces of the tongue portion.

13. The panel of claim 2 wherein the panel is rectangular having two long sides and two short sides with one of the long sides having a tongue portion and the other long side having a groove portion and with one of the short sides having a tongue portion and the other short side having a groove portion.

14. The panel of claim 2 wherein the groove portion is a at least one compound recess having more than one channel and the deposit is at least one single continuous mass.

15. The panel of claim 14 wherein the tongue portion has a pair of surfaces and a compound recess are in each surface and wherein the groove portion has a pair of opposed walls and a deposit configured as a continuous mass on each wall in alignment with the groove portion.

16. The panel according to claim 2 wherein there are at least two first recesses in one of the portions, which recesses have different cross-sectional configurations and wherein there are deposits of different cross-sectional areas within second recesses in the other portion.

17. The panel according to claim 2 wherein the recess is a first recess that is V-shaped and the deposit is in a groove with arcuate sides that form a second recess.

18. The panel of claim 17 wherein the first recess is in the tongue portion and the second recess is in the groove portion.

19. The panel of claim 2 wherein the deposit of adhesive is a bead of polymer cement which is emulsified by water and has a thickness of a range of 0.1 to 0.6 mm.

20. The panel of claim 19 wherein the deposit of adhesive has a thickness in a range of 0.2 to 0.5 mm at a thickness tolerance in the range of +0.05 to 0.1 mm, the adhesive being a polyvinyl acetate adhesive or a wood glue.

21. The panel of claim 20 wherein the deposit has a thickness which is in the range of 5 to 25% of the height of the groove portion.

22. The panel of claim 20 wherein the deposit of thickness has a thickness which is in the range of 9 to 21% of the height of the groove.

23. The panel of claim 20 wherein the thickness of the deposit of adhesive is in the range of 12 to 17% of the height of the groove.

24. The panel of claim 2 wherein the deposit of adhesive is disposed in a second recess and extends over the portion beyond the recess.

25. The panel of claim 2 wherein the tongue portion extends transverse of the panel and the groove portion extends transverse of the panel.

26. The panel of claim 2 wherein the deposit has a cross-section at least prior to insertion of the tongue portion into the groove portion which is semicircular, lenticular, elliptical or elongated-rectangular in shape.

27. The panel of claim 2 wherein the deposit of adhesive has a transition from the surface of the tongue portion or surface of the wall, which transition is rounded or beveled.

28. The panel of claim 2 wherein a leg of the panel defining the groove portion is elastic and flexes as the deposit is inserted into the groove portion.

29. The panel of claim 2 wherein the tongue portion is a separate member from the panel, the tongue portion being inserted into an edge slot during fabrication of the panel to form a panel having a tongue portion and a groove portion.

30. The panel of claim 2, wherein the deposit of adhesive comprises an adhesive-latent cement material, preferably a polymer cement which can be emulsified with water, the cement material being transformed by moistening with water into an adhesive-ready or adhesive state.

31. The panel of claim 2, wherein the deposit of adhesive is a plastic material which can be again activated after initial drying by water or moisture and is applied with a substantially uniform layer thickness of 0.1 to 0.6 mm with thickness tolerances in the range of ±0.05 to 0.1 mm.

32. The panel of claim 2, wherein the deposit of adhesive by a quick-setting polyvinyl acetate adhesive, or by a starch or protein wood glue.

33. The panel of claim 2 wherein the deposit is coextensive with the portion in spaced relation to the edge of the panel.

34. The cladding panel of claim 33 wherein the recess is a first recess that is V-shaped and the deposit is in a groove with arcuate sides that form a second recess.

35. The panel of claim 34 wherein the first recess is in the tongue portion and the second recess is in the grooved portion.

36. A cladding panel for coupling with an adjacent complementary panel, the cladding panel comprising:

a tongue portion extending from a first edge of the cladding panel for receipt in a groove in a complementary cladding panel;

a groove portion having walls extending in a second edge of the cladding panel for receiving a tongue portion of a complementary cladding panel;

at least one linear deposit of applied material configured as at least one bead or line of plastic material deposited on and fixed to one of the portions as a solid prior to coupling with an adjacent complementary panel, the applied material being of a hardness and a viscosity sufficient to withstand insertion of the tongue portion into the groove portion without significant change of shape, and at least one recess on the other portion for receiving the linear deposit of applied material therein to initially positively latch the tongue and groove portions together when the cladding panel is coupled with a complementary cladding panel.

37. The panel of claim 36 wherein the plastic material is silicone plastic, polyalkylene plastic, polyvinylchloride, polyethylene, or polypropylene or hot melt neoprene cement.

38. The panel of claim 36 wherein the plastic material is plastic deformably by heat comprising thermoplastics elastomers or thermoplastic elastomers.

39. The panel of claim 36 wherein the plastics are thermoplastics comprising polyolefins, vinyl polymers, polyamides, polyester, polyurethane or ionomers.

40. The panel of claim 36 wherein the plastic material is a thermoplastic elastomer comprising TPE, TPR, TPO, SPS, TP-Q or TP-U.

41. The panel of claim 36 wherein the plastic material is a hot-melt or hot sealing cement comprising ethylene vinyl chloride, PA, PU or EA.

42. The panel of claim 36 wherein the bead or line of plastic is on the tongue portion and wherein the recess portion is a wall of the groove.

43. The panel of claim 36 wherein there is more than one bead or line of plastic on the tongue portion and more than one recess in the wall of the groove portion.

44. The panel of claim 43 wherein the tongue portion has two converging surfaces that converge toward a free end.

45. The panel of claim 44 wherein the beads or lines of plastic are on both converging surfaces and wherein the recesses are in opposed converging walls of the groove portion.

46. The panel of claim 36 wherein the recess is in the tongue portion and the bead or line of plastic is on one of the walls of the groove portion.

47. The panel of claim 36 wherein there is more than one recess in the tongue portion and more than one bead or line of plastic on the walls of the groove portion.

48. The panel of claim 47 wherein the tongue portion has surfaces which converge toward a free end and the groove portion has walls which converge toward a bottom and have the bead or line of plastic thereon.

49. The panel of claim 36 wherein the tongue portion has two surfaces with a recess in one surface and a bead or line of plastic on the other surface, and wherein the groove portion has two opposed walls with a recess in one wall for receiving a deposit on the tongue portion and a bead or line of plastic on the other wall for receipt in a recess in the tongue portion.

50. The panel of claim 36 wherein the tongue portion has two surfaces each of which has a recess and wherein the groove portion has two walls each of which has a bead or line of plastic, the deposits of adhesive being disposed in recesses in the walls for receipt in the recesses in the surfaces of the tongue portion.

51. The panel of claim 36 wherein the panel portion is rectangular having two long sides and two short sides with one of the long sides having a tongue portion and the other long side having a groove first portion and with one of the short sides having a second tongue portion and the other short side having a groove second portion.

52. The panel of claim 36 wherein the groove portion is a compound groove having more than one channel and the bead or line of plastic is a single continuous mass.

53. The panel of claim 49 wherein the tongue portion has a pair of surfaces with a compound groove in each surface and wherein the groove portion has a pair of opposed walls and a bead or line of plastic configured as a continuous mass on each wall in alignment with the groove portion.

54. The panel according to claim 36 wherein there are at least two first recesses in one of the portions, which recesses have different cross-sectional configurations and wherein there are beads or lines of different cross-sectional areas within second recesses in the other portion.

55. The panel according to claim 36 wherein the recess is a first recess that is V-shaped and the bead or line of plastic is in a groove with arcuate sides that form a second recess.

56. The panel of claim 55 wherein the first recess is in the tongue portion and the second recess is in the groove portion.

57. The panel of claim 36 wherein the bead or line of plastic has a thickness which is in the range of 9 to 21% of the height of the groove portion.

58. The panel of claim 36 wherein the thickness of the bead or line of plastic is in the range of 12 to 17% of the height of the groove portion.

59. The panel of claim 36 wherein the bead or line of plastic is disposed in a second recess and extends over the portion beyond the recess.

60. The panel of claim 36 wherein the tongue portion extends transverse of the panel and the groove portion extends transverse of the panel.

61. The panel of claim 36 wherein the bead or line of plastic has a cross-section at least prior to insertion of the tongue portion into the groove portion which is semicircular, lenticular, elliptical or elongated-rectangular in shape.

62. The panel of claim 36 wherein the bead or line of plastic has a transition from the surface of the tongue portion or surface of the wall, which transition is rounded or beveled.

63. The panel of claim 36 wherein a leg of the panel defining the groove portion is elastic and flexes as the bead is inserted into the groove portion.

64. The panel of claim 36 wherein the tongue portion is a separate member from the panel, the tongue portion being inserted into an edge slot during fabrication of the panel to form a panel having a tongue portion and a groove portion.

65. The panel of claim 36 wherein the bead or line of plastic material is coextensive with the portion and is located in spaced relation to the edge of the panel.

66. A cladding panel for coupling with an adjacent complementary panel, the cladding panel comprising:

a tongue portion extending from a first edge of the cladding panel for receipt in a groove in a complementary cladding panel;

a groove portion having walls extending in a second edge of the cladding panel for receiving a tongue portion of a complementary cladding panel;

at least one linear deposit of applied adhesive configured as at least one solid bead or line deposited on one of the portions, the applied adhesive being of a hardness and a viscosity sufficient to withstand insertion of the tongue portion into the groove portion without significant change of shape, and at least one recess on the other portion for receiving the linear deposit of applied adhesive therein to initially positively latch the tongue and groove portions together when the cladding panel is coupled with a complementary cladding panel.

* * * * *

UNITED STATES PATENT AND TRADEMARK OFFICE

CERTIFICATE OF CORRECTION

PATENT NO. : 7,188,456 B2
APPLICATION NO. : 10/231480
DATED : March 13, 2007
INVENTOR(S) : Franz Knauseder It is certified that error appears in the above-identified patent and that said Letters Patent is hereby corrected as shown below:

Column 10, line 54, reads “having to a hardness” should read -- having a hardness --
Column 10, line 57, reads “loosing an ability” should read -- losing an ability --
Column 11, line 42, reads “groove portion is a” should read -- groove portion is --
Column 13, line 11-12, reads “thermoplastics elastomers” should read -- thermoplastics, elastomers --
Column 13, line 66, reads “panel of claim 49” should read -- panel of claim 52 --

Signed and Sealed this

Twenty-ninth Day of April, 2008

JON W. DUDAS
*Director of the United States Patent and Trademark Office*